US007997215B2

(12) United States Patent
De Keyzer

(10) Patent No.: US 7,997,215 B2
(45) Date of Patent: Aug. 16, 2011

(54) TABLE ADJUSTABLE IN HEIGHT

(75) Inventor: Hans De Keyzer, Menen (BE)

(73) Assignee: Group De Keyzer BVBA, Menen (BE)

( * ) Notice: Subject to any disclaimer, the term of this patent is extended or adjusted under 35 U.S.C. 154(b) by 1421 days.

(21) Appl. No.: 11/071,188

(22) Filed: Mar. 4, 2005

(65) Prior Publication Data

US 2005/0199161 A1 Sep. 15, 2005

(30) Foreign Application Priority Data

Mar. 9, 2004 (BE) ..... 2004/0128

(51) Int. Cl.
*A47B 11/00* (2006.01)

(52) U.S. Cl. ..... 108/136; 108/147; 108/147.19

(58) Field of Classification Search ..... 108/136, 108/144.11, 147, 147.19
See application file for complete search history.

(56) References Cited

U.S. PATENT DOCUMENTS

| | | | | |
|---|---|---|---|---|
| 3,092,048 | A * | 6/1963 | Timmermann | 108/138 |
| 6,182,583 | B1 * | 2/2001 | Larson | 108/147 |
| 6,189,843 | B1 * | 2/2001 | Pfister | 248/161 |
| 6,397,761 | B1 * | 6/2002 | Moore | 108/50.01 |
| 6,550,728 | B1 * | 4/2003 | Fuhrman | 248/188.5 |

* cited by examiner

*Primary Examiner* — Hanh V Tran
(74) *Attorney, Agent, or Firm* — James Creighton Wray

(57) ABSTRACT

The invention relates to a table (1) comprising an up-and-down movable tabletop (2) and operating provisions to move the tabletop (2) up and down, characterized in that the operating provisions are located under the tabletop (2) and that they can be reached by hand. Said operating provisions preferably comprise an operating ring (3) movable against a resilient force.

8 Claims, 5 Drawing Sheets

TABLE ADJUSTABLE IN HEIGHT

This application claims the benefit of Belgian Application No. 2004/0128 filed Mar. 9, 2004.

Belgian Application No. 2004/0128 filed Mar. 9, 2004 is hereby incorporated by reference in its entirety.

BACKGROUND OF THE INVENTION

The invention relates to a table comprising on the one hand an up-and-down movable tabletop and on the other hand operating provisions to move the tabletop up and down. More in particular, the invention relates to a table adjustable in height by means of an operating ring.

From an ergonomics point of view, the height of a table, more in particular the height of its tabletop, is important: indeed, a too low table may cause back complaints whereas a too high table may give rise to shoulder complaints. Therefore, it is important that tables at which several different persons can be seated, such as in restaurants, in public places, on cruise ships, etc., are provided with a tabletop that can be adjusted in height.

There already are tables of which we know that their top is adjustable at two heights, i.e. a low position and a high position. To facilitate the upward movement, such tables are provided with a gas-operated or oil-operated pressure spring in their central base. To put the tabletop at a higher or lower position, the pressure spring is activated by pressing a handle incorporated in the central base.

However, such known tables present the disadvantage of having their operating handle incorporated in the central base, which is not very esthetic. In addition, because of its location, i.e. at the lower part of the table, the handle is hard to reach by hand so that in most cases it is foot-operated. Because of this, the handle is particularly subject to wear so that it must be replaced after a certain time.

In the American patent U.S. Pat. No. 6,189,843, a table adjustable in height is disclosed, in which the height of the tabletop can be adjusted by means of a handle. However, a distinct disadvantage of this table is that a person who finds himself out of reach of the handle will hardly be able to adjust the height of the tabletop.

The purpose of the present invention is to provide a table with an up-and-down moving tabletop that does no longer present these disadvantages.

SUMMARY OF THE INVENTION

The purpose of the invention is realized by providing a table comprising an up-and-down movable tabletop and operating provisions to move the tabletop up and down, characterized in that the operating provisions extend over a major part of the surface of the tabletop, in the vicinity of the edge of the tabletop, and in that the above-mentioned operating provisions are so located that they can be reached by hand under the tabletop. Said operating provisions preferably comprise an operating ring movable against a resilient force. In the case of a round tabletop, the operating ring preferably has a smaller diameter than that of the tabletop; the ring is also provided with a rod that divides the ring in two parts.

The advantage of such embodiment is that activation of the system to enable the up-and-down movement of the tabletop, and simultaneous pressing on the tabletop (for the down movement) can take place by a single operation and in an ergonomic manner.

In this patent application, with the expression: "the operating provisions can be reached by hand from the tabletop" is meant that, when the flat of the hand rests on the tabletop, one can touch the operating provisions with one's fingertips. In a preferred embodiment, the operating provision, preferably the operating ring, is located 1 to 5 cm underneath the tabletop, in ideal circumstances, said ring is located 5 cm underneath the tabletop.

In a preferred embodiment of the table according to invention, two support elements are provided, comprising at least a first part and a second part, movable in relation to each other, the tabletop being connected to the second part and the operating ring being provided in the area where the tabletop is connected to the second part.

In a more preferred embodiment of the table according to invention, the first and second parts are installed movably in relation to each other, the movement of both parts being achieved by means of a pressure spring. The pressure spring is preferably a gas spring or an oil spring.

In a particularly advantageous embodiment of the table according to invention, the first and second parts are two precision tubes, sliding into each other, the second part being provided with a protrusion that fits in a recess provided in the first part. Said protrusion is preferably a spline fitting in a lengthwise running recess of the first part. This ensures that the tabletop can no longer swivel.

In another preferred embodiment of the table according to invention, the first and second parts are two precision tubes sliding into each other, the first part being provided with a protrusion, preferably a spline, fitting in a recess (groove) provided in the second part. This embodiment provides an even higher degree of stability.

In a most preferred embodiment of the table according to invention, the operating ring is connected by bolts to the second part. By a construction of preferably steel precision tubes, sliding into each other, with minimum tolerances, in combination with a robust activation system anchored by means of bolts, an exceptionally high degree of stability is obtained.

To further explain the properties of this invention and to indicate additional advantages and particularities of it, we now will provide a more detailed description of a table adjustable in height according to invention. It should be clear that nothing in the following description should be interpreted as a limitation of the invoked protection for this invention as set forth in the claims.

In this description, reference is made by means of reference numbers to the enclosed drawings in which:

DETAILED DESCRIPTION OF THE PREFERRED EMBODIMENTS

Figure 1:
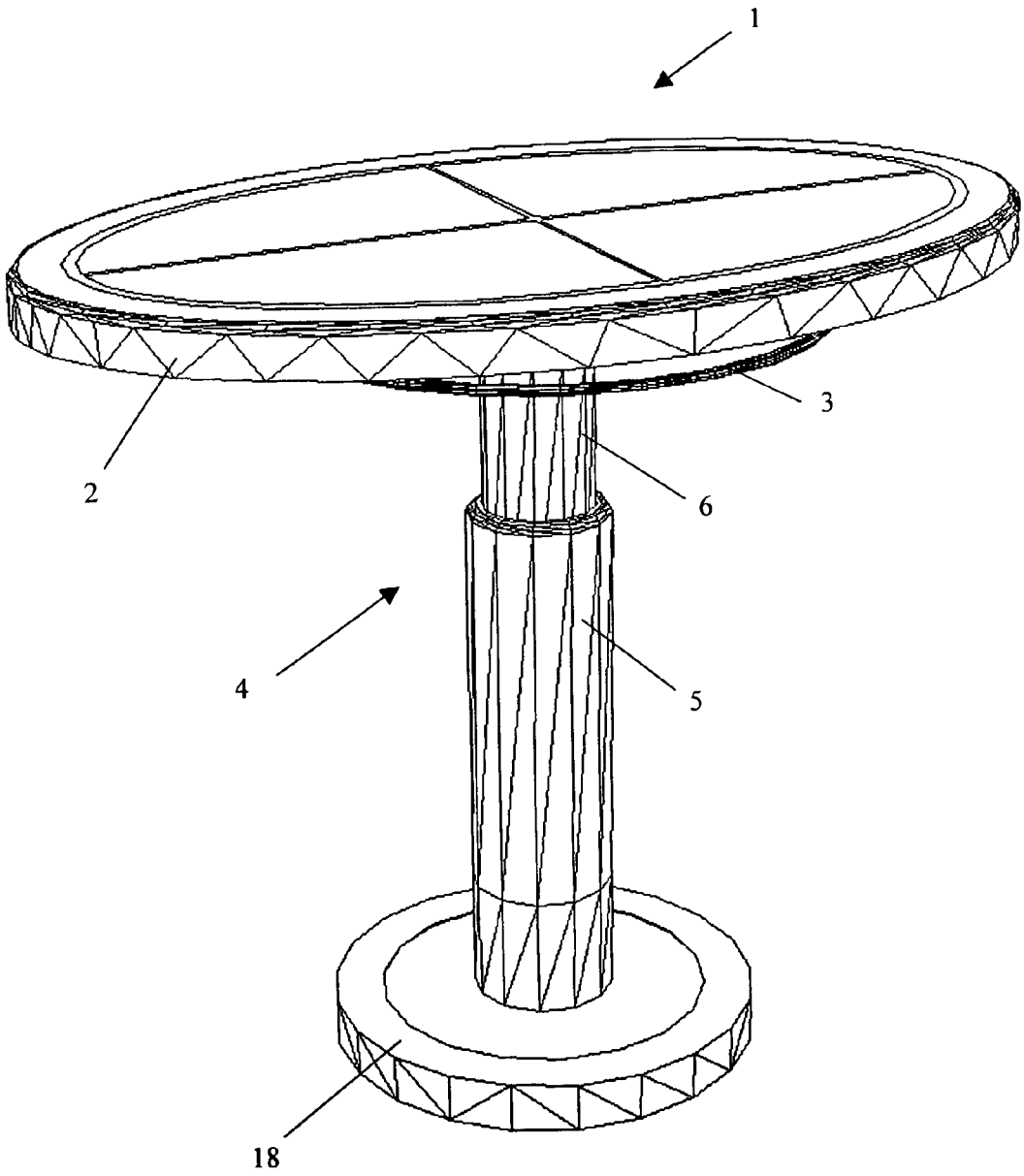
FIG. 1 illustrates a perspective view of a table according to the invention.

The table (1) according to the invention is a table adjustable in height, which could also be called a "pop-up" table. The table (1) as illustrated in FIG. 1 has an oval tabletop (2) and is provided with an operating ring (3) for activation of the up-and-down movement of the tabletop (2). The top (2) can be moved between an upper and lower position and can be set to any intermediate position. As soon as the operating ring (3) is released, the tabletop (2) remains at its current height.

The tabletop (2) is connected to the supporting elements (4) provided on a central base (18). The operating ring (3) can be reached by hand from the tabletop (2) and is provided in the area between the tabletop (2) and the supporting elements (4).

Figure 2:
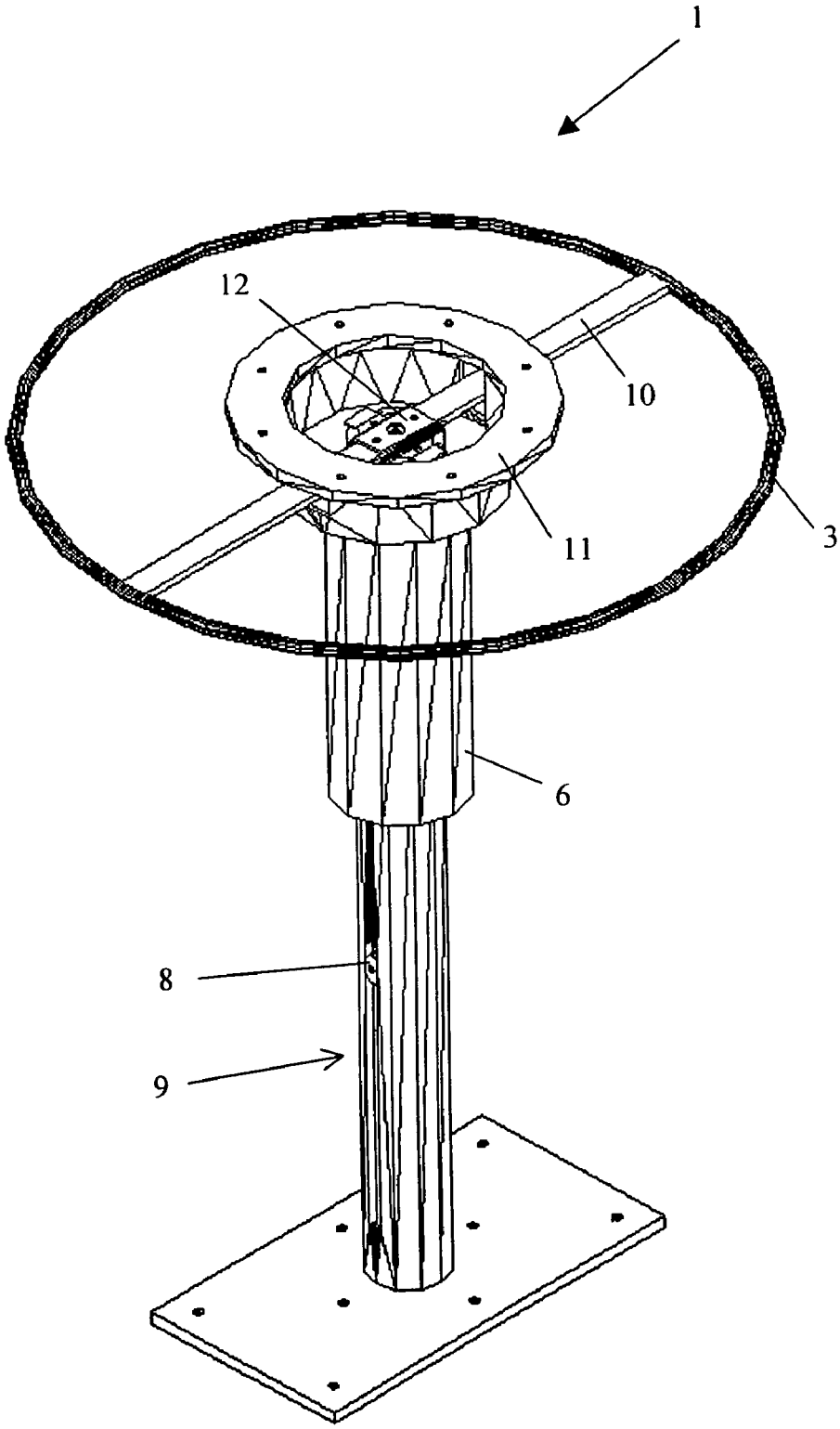
FIG. 2 illustrates a perspective view of a table according to the invention of which the tabletop has been removed.
Figure 3:
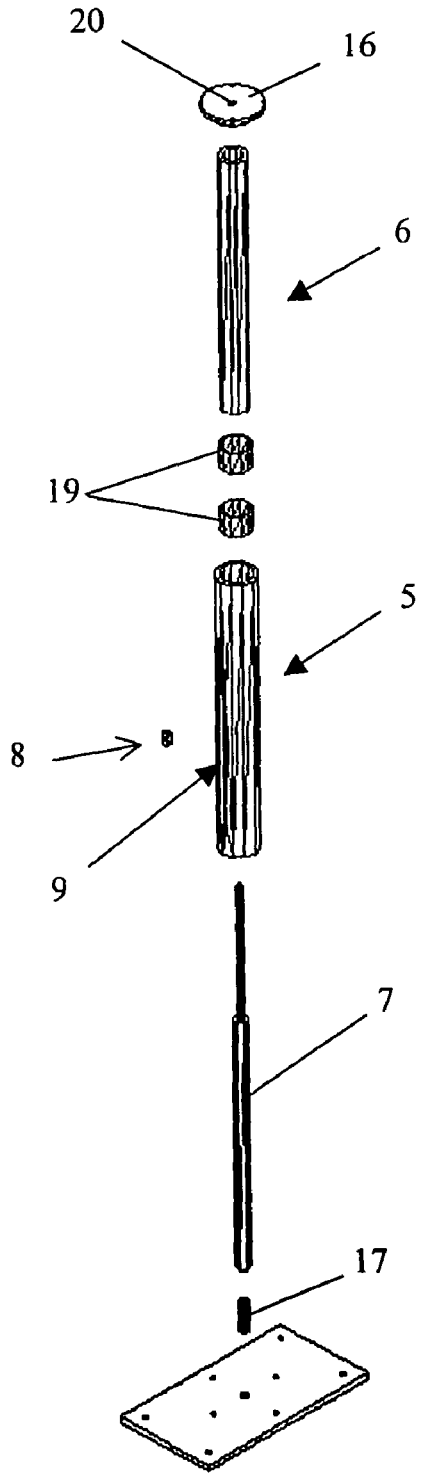
FIG. 3 illustrates an exploded view of the first and second parts characterized in that a spline is provided on the second part.
Figure 4:
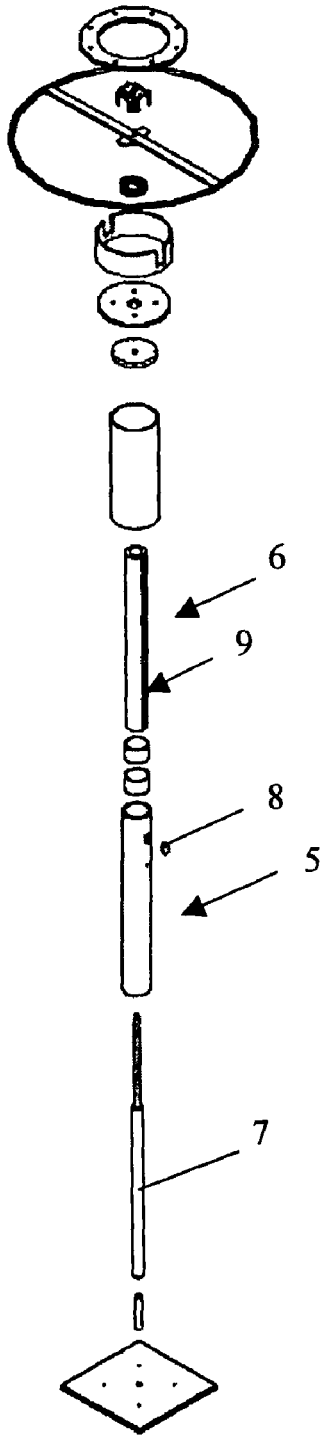
FIG. 4 illustrates an exploded view a of the first and second parts characterized in that a spline is provided on the first part.

To provide stability to the table (1) the supporting elements (4) comprise a first part (5) and a second part (6), movable in relation to each other. Said parts are preferably two precision tubes (5 and 6) sliding into each other. To prevent the tabletop (2) from swiveling, the second part (6) as presented in FIGS. 2 and 3 is provided with a spline (8) that fits in a lengthwise running recess (9) of the first part (5). In another embodiment as illustrated in FIG. 4, the first part (5) may be provided with a spline (8) that fits in a groove (recess) (9) of the second part (6), in order to obtain a higher degree of stability.

As illustrated in FIG. 3, the tube with the largest diameter, i.e. the first part (5), is connected, for instance by welding, to a steel plate (18). The tube with the smallest diameter, i.e. the second part (6), slides into the first part (5). The second part (6) has an outer diameter that fits precisely into the inner diameter of the first part (5). To have the tubes (5 and 6) slide perfectly into each other, a slide bush (19) is provided on the first part (5).

The sliding motion of the tubes (5 and 6) is obtained by means of a pressure spring (7), preferably a gas-operated or oil-operated pressure spring, provided in said tubes. At its bottom, the spring (7) is attached through an extension part (17) to the steel plate (18). The other side of the spring (7), i.e. the side where the activating point is located, is screwed in an opening (20) of a steel pad (16) welded to the second part (6) (see FIG. 3).

Figure 5:
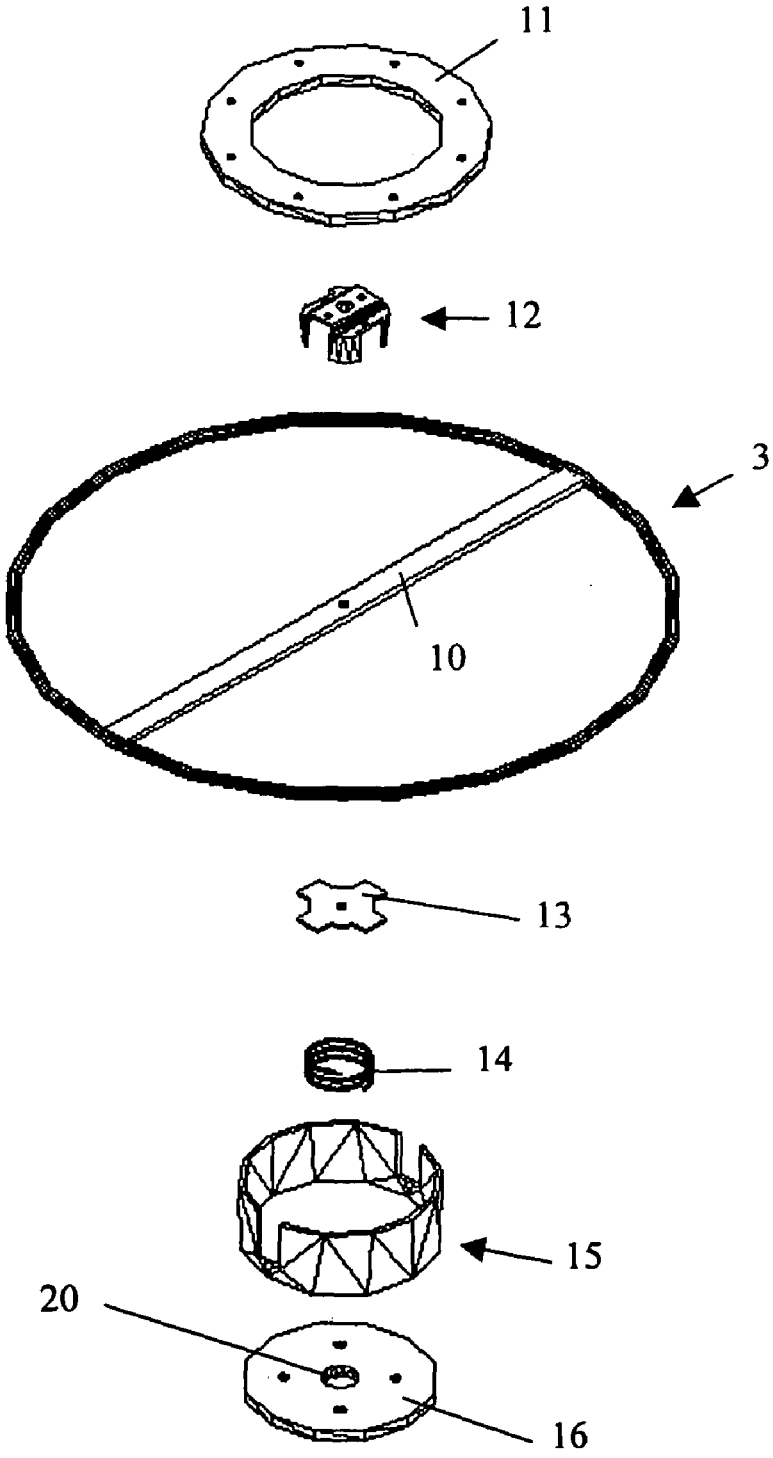
FIG. 5 illustrates an exploded view of the area where the tabletop is connected to the second part.

The operating ring (3) can be moved against a resilient force and is preferably performed as a welded steel construction fitting on the pad (16) welded to the second part (6). Said construction is illustrated in FIG. 5 and it comprises a covering tube (15) connected, preferably by welding, to the pad (16) on the second part (6). The covering tube (15) is provided with two recesses in which the rod (10) of the operating ring (3) fits. By placing a metal ring (11) on the covering tube (15), the operating ring (3) is secured in place. The ring (11) provided to fasten the operating ring (3) is preferably connected to the tabletop (2) by means of bolts.

To said rod, (10) an operating rosette (13) is connected, resting on a spring (14) placed in the covering tube (15). The spring (14) is tensioned by means of a tensioning cap (12) placed over the rod (10) and welded to the pad (16). The operating rosette (13) enables activation of the up-or-down movement regardless of the spot where we pull on the operating ring (3).

Activation is possible at every point of the operating ring (3). If a round tabletop (2) is used, the operating ring (3) can be reached from anywhere around the tabletop (2). For oval tabletops for instance, the operating ring (3) can be reached from the sides perpendicular to the smallest diameter of the oval.

For instance, to lower the tabletop (2), the operator pulls with his fingertips at any single place on the operating ring (3), while at the same time he pushes the tabletop (2) down with the flat of his hand and by means of his body weight. By pulling on the operating ring (3), the rod (10) takes an inclined position and the spring (10) is compressed. As a result, the operating rosette (13) will touch the activating point of the pressure spring (7) located in the opening (20) of the pad (16) attached to the second part (6). The pressure spring (7) will be activated and the second part (6) will slide into the first part (5).

The same applies, but without need of any assistance from one's body weight, to the upward movement of the tabletop (2). Indeed, as soon as we pull on the operating ring (3) the second part (6) will slide out of the first part (5) under the influence of the pressure spring (7).

The invention claimed is:

1. A table comprising an up-and-down movable tabletop, and operating provisions to move the tabletop up and down wherein the operating provisions comprise an operating ring, extending along a circumferential line underneath the tabletop in the vicinity of the edge of the tabletop, said operating provisions being located in a way that they can be reached by hand under the tabletop, and wherein the operating ring is movable against a resilient force.

2. A table according to claim 1, wherein support elements are provided, comprising at least a first part and a second part, movable in relation to each other, the tabletop being connected to the second part and in which the operating ring is provided in the area where the tabletop is connected to the second part.

3. A table according to claim 2, wherein the first part and the second part are installed movably in relation to each other, the movement of both parts being achieved by means of a pressure spring.

4. A table according to claim 3, wherein said pressure spring is a gas spring.

5. A table according to claim 2, wherein the first part and the second part are two precision tubes sliding inside each other, the second part being provided with a protrusion fitting in a recess provided in the first part.

6. A table according to claim 2 wherein the operating ring is connected by bolts to the second part.

7. A table comprising an up-and-down movable tabletop, and operating provisions to move the tabletop up and down wherein the operating provisions extend over a major part of the surface of the tabletop, in the vicinity of the edge of the tabletop, said operating provisions being located in a way that they can be reached by hand under the tabletop, wherein said operating provisions comprise an operating ring, extending along a circumferential line underneath the tabletop, wherein support elements are provided, comprising at least a first part and a second part, movable in relation to each other, the tabletop being connected to the second part and in which the operating ring is provided in the area where the tabletop is connected to the second part, wherein the first part and the second part are installed movably in relation to each other, the movement of both parts being achieved by means of a pressure spring, and wherein said pressure spring is an oil spring, and wherein the operating ring is movable against a resilient force.

8. A table comprising an up-and-down movable tabletop, and operating provisions to move the tabletop up and down wherein the operating provisions comprise an operating ring, extending along a circumferential line underneath the tabletop in the vicinity of the edge of the tabletop, said operating provisions being located in a way that they can be reached by hand under the tabletop, wherein the operating ring is movable against a resilient force, and wherein to lower the tabletop, the operator pulls with his fingertips at any single place on the operating ring, while at the same time he pushes the tabletop down with the flat of his hand and by means of his body weight.

* * * * *